United States Patent [19]

Schimmel et al.

[11] Patent Number: 4,526,747

[45] Date of Patent: Jul. 2, 1985

[54] PROCESS FOR FABRICATING PARTS SUCH AS GAS TURBINE COMPRESSORS

[75] Inventors: William P. Schimmel, Milford; Clifford S. Barker, Kalamazoo; Dana P. Jones, Walled Lake, all of Mich.

[73] Assignee: Williams International Corporation, Walled Lake, Mich.

[21] Appl. No.: 359,575

[22] Filed: Mar. 18, 1982

[51] Int. Cl.[3] ..... B22F 7/08; B22F 3/16; B22F 5/04

[52] U.S. Cl. ..... 419/8; 419/42; 419/68; 29/156.8 R

[58] Field of Search ..... 419/8, 38, 49, 53, 68, 419/42; 29/156.8 R

[56] References Cited

U.S. PATENT DOCUMENTS

| | | | |
|---|---|---|---|
| 2,847,708 | 8/1958 | Hamjian et al. | 419/42 X |
| 3,940,268 | 2/1976 | Catlin | 29/156.8 R |
| 4,063,939 | 12/1977 | Weaver et al. | 419/49 |
| 4,097,276 | 6/1978 | Six | 419/8 |

OTHER PUBLICATIONS

Lenel, *Powder Metallurgy, Principles and Applications*, MP1F, Princeton, N.J., 1980, p. 333.

*Primary Examiner*—Benjamin R. Padgett
*Assistant Examiner*—Matthew A. Thexton
*Attorney, Agent, or Firm*—Lyman R. Lyon

[57] ABSTRACT

The disclosure relates to a method of manufacturing a turbine wheel using an elastomeric mold for the acceptance of powdered metal. The powdered metal is cold isostatically pressed and thereafter heated to effect metallurgical bonding thereof.

2 Claims, 2 Drawing Figures

PROCESS FOR FABRICATING PARTS SUCH AS GAS TURBINE COMPRESSORS

BACKGROUND OF THE INVENTION

The aerospace industry has developed various powder metalurgy techniques over the last several decades to produce near-net shapes in engine and airframe structures to effect savings in finishing labor and material. Such techniques directly produce a net shape or near net shape from raw material. Powder metallurgy techniques offer the potential of producing compressor wheels with various combinations of aluminum, steel, and titanium in the blade and hub. The capability of using different alloys to construct the various regions of the compressor permits tailoring of the composition and processing for each region to the critical requirements of that location.

The principal processes heretofore utilized have been: (a) cold isostatic pressing and sintering, and (b) cold isostatic pressing, sintering, followed by hot isostatic pressing.

One of the attributes desired in a mold for cold isostatic pressing is that the mold be sufficiently flexible to accommodate the volume change associated with compaction. On the other hand, the mold must be sufficiently rigid to preclude penetration of the powder particles, as this makes it difficult to strip the envelope from the compact and is a potential source of contamination. Moreover, the mold must have the ability to withstand, when unsupported, a moderate internal pressure without bursting as well as the capability of being easily and reliably sealed.

Several materials meet the above requirements in varying degree. For example, natural and synthetic rubber, silicone elastomers, and PVC are commonly employed. The selection of an envelope depends upon the number of components required, as well as their shape and size. The type of operation in which the powder is completely encased in an envelope and the whole assembly subjected to isostatic pressing is known as "wet-bag" tooling. "Wet bag" tooling is suitable for producing complex forms or for short production runs. Filling is done with the mold removed from the pressure chamber. After filling, the elastomeric mold is usually de-aired for better compaction, sealed and placed into the pressure chamber. If the chamber is large enough, several molds can be pressed at the same time.

Isostatic compaction tends to result in increased and uniform density at a given compaction pressure. This is a consequence of more uniform pressure distribution within the compact and the absence of die-wall friction.

Isostatic pressing was first used to prepare billets of refractory metal powders as disclosed in U.S. Pat. No. 1,081,618, issued Dec. 16, 1913, to H. D. Madden, entitled "Process of Preparing Billets of Refractory Materials". The process was further used and developed to make refractory metal tube as disclosed in U.S. Pat. No. 1,226,470, issued May 15, 1917, to W. D. Coolidge, entitled "Refractory Metal Tube". However, it was not used in significant production until the late 1930's at which time it was utilized in the production of blanks for the insulators of spark plugs as disclosed in U.S. Pat. No. 1,863,854, issued June 21, 1932, to B. A. Jeffery, entitled "Method and Apparatus for Shaping Articles".

Isostatic pressing has gained rapidly since 1955 as the result of a great deal of research and development by Battelle Memorial Institute. In addition, a number of patents have issued on specific applications of the process. For example, U.S. Pat. No. 4,063,939, to Weaver teaches use of a mold to define the final shape of a powder metal material. Powdered metal is placed in the mold along with prefabricated blades and further processed to become a metallurgically bonded structural part. Hot isostatic pressing of the part is used for final densification to approach 100% density and diffusion bonding of the blades to the powder hub.

It is to be noted, however, that the Weaver process takes the mold and powder to high sintering temperatures thereby giving the part shape and strength. Moreover, the Weaver process uses a rigid mold.

U.S. Pat. No. 4,097,276 to Six, teaches use of a container filled with powder and prefabricated blades similar to Weaver. The Six sealed assembly is heated and isostatically pressed simultaneously to get shape and structure where Weaver uses sintering first, for shape and then hot isostatic pressing secondly for structure.

Catlin, U.S. Pat. No. 3,940,268, teaches the use of a rigid container for the shaping of turbine wheels which requires hot isostatic pressing for shape and structure. The Catlin process is very similar to the Six disclosure except that Catlin specifically teaches the use of metallic blades.

Webb, U.S. Pat. No. 3,000,081, discloses a process distinctly different from the aforesaid patents in that molten metal is poured around pre-fabricated blades or metal is hot forged to flow around the roots of pre-fabricated blades.

Bloomberg, U.S. Pat. No. 2,897,318, teaches a method using a casting process for locating and bonding pre-fabricated blades.

More recently, it was found that cold isostatic pressing plus sintering of Ti-6Al-4V titanium alloys could produce from 90–98% dense compacts having tensile strengths above 110 ksi with acceptable elongation at the higher densities. Controlled vacuum sintering is required for parts that have been cold-compacted. Sintering takes place between 2250° F. and 2450° F. usually in two to four hour cycles.

SUMMARY OF THE INVENTION

The instant invention relates to an improved process for making compressor rotors or the like.

More specifically, the process of the instant invention uses "wet bag" tooling comprising a mold of elastomeric, non-rigid material, to give the part shape. The mold allows the transmission of high hydrostatic pressure in a cold press operation. Because the shape of the part is developed at ambient temperature the cost of processing is minimized. Thereafter, the "green" cold formed part is loaded, without the mold, into a sintering furnace in a relatively high packing ratio of finished parts to furnace volume. It is to be noted that molds taught in the prior art remain intact around the parts during sintering.

Moreover, the cost of making a thin elastomeric mold is significantly less than the cost of making rigid ceramic molds taught in the prior art.

DETAILED DESCRIPTION OF THE PREFERRED EMBODIMENT OF THE INVENTION

Figure 1:
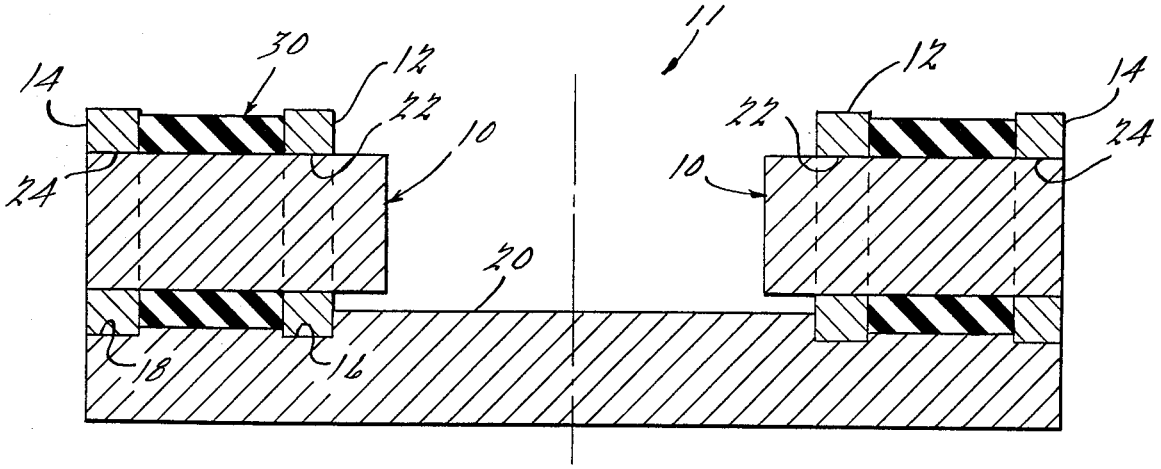
FIG. 1 is a sectional elevation of the blade location tooling used to form an internal elastomeric support ring for the compressor blades.

Referring to FIG. 1 of the drawing, conventional rolling may be used to form blades 10 to a desired cross section, generally an airfoil. The blades 10 can be twisted, if required, to optimize compressor performance. If desired, a coating may be put on the blades 10 where they inbed into the powdered metal hub to enhance metallurgical bonding to the powdered metal. The coating is generally applied by electroless nickel plating, electroplating, vapor deposition, chemical vapor deposition, or a similar process. The coating generally comprises a thin film of metal or metal alloy, such as Ni-Boron, NiSi, etc.

Blade location tooling, generally designated by the numeral 11, is used to locate the individual blades 10 and comprises precision inner and outer rings 12 and 14 that are mounted in complementary annular grooves 16 and 18, respectively, in a base plate 20. The blades 10 are merely inserted through complementary slots 22 and 24 in the rings 12 and 14, respectively.

Liquid rubber or an artificial elastomeric compound is poured over the blades 10 and allowed to cure to an elastomeric ring 30. The blades 10 are then removed from the elastomeric ring 30, as well as from the inner and outer rings 12 and 14, by sliding the blades 10 radially. The elastomeric ring 30 is then removed from the blade location tooling 11.

Figure 2:
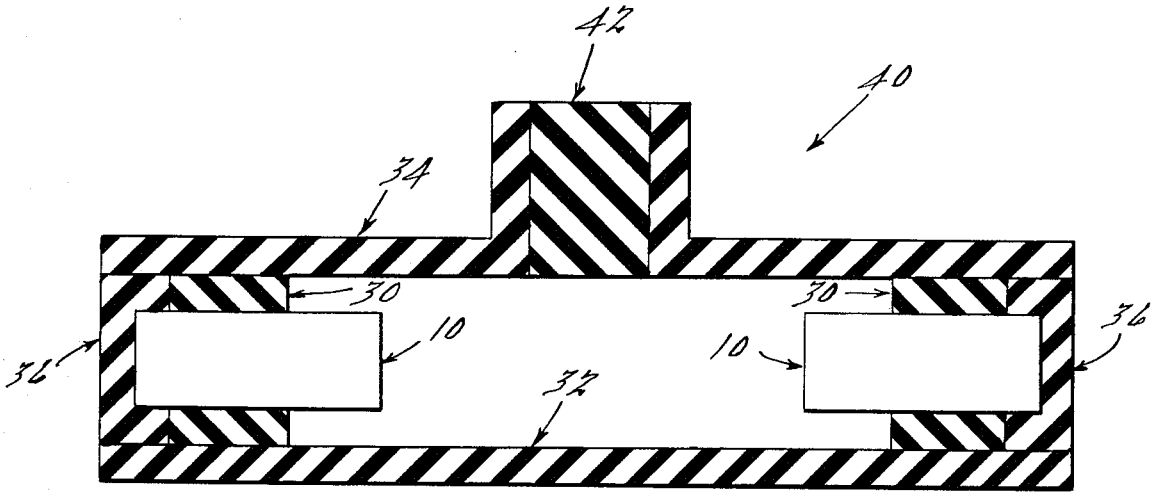
FIG. 2 is a view, similar to FIG. 1, with the blade location tooling removed and the elastomeric envelope in position.

The elastomeric ring 30 is then adhesively bonded to a bottom disc 32 of elastomeric material, the blades 10 reinserted, and an elastomeric cover 34 adhesively bonded to the ring 30, as shown in FIG. 2. At this point, the blades 10 are located precisely in the elastomeric ring 30. Thereafter an elastomeric outer ring 36 is formed thereabout to effect sealing of the periphery of the mold. The cavity formed by the open area between the elastomeric mold portions 30, 32, and 34 defines the dimensions of the powdered metal hub to be formed. A mandrel, not shown, may be used in the center of the cavity to form a hole in the finished hub, if desired.

The elastomeric mold shown in FIG. 2 and generally designated by the numeral 40, is then filled with powdered metal and sealed with liquid elastomer or a plug 42. Optional operations to improve quality prior to sealing are vibration of the powder, centrifuging, evacuation of the mold/powder assembly before sealing, etc. Auxiliary binders may be used to give high green strength for handling of the cold pressured part prior to sintering.

After the elastomeric mold 40 is filled with powdered metal, it is placed in a conventional cold isostatic press and pressurized to compact the powder and blade assembly to a shape that, in and of itself, has strength sufficient for handling. As opposed to die compaction, isostatic pressing is not limited by the ratio of height to cross-sectional area. The pressures needed to achieve sufficient green strength for handling after isostatic pressing are essentially equivalent to the yield strength of the material. For example, elemental titanium powder achieves a green density, 84% of theoretical, at a pressing pressure of 30 TSI. To achieve an equivalent green density of prealloyed 6Al-4V-titanium powder, it is necessary to press at 70 TSI which is essentially the yield strength of the alloy.

After cold pressing the mold 40 is stripped off. A sintering cycle is now employed to accomplish metallurgical bonding between the powdered metal particles themselves and between the powdered metal and the blades 10. Sintering can be performed in a vacuum or controlled atmosphere furnace.

An optical process step can be performed subsequent to the heating cycle comprising hot isostatic pressing. This operation will effect consolidation of the powdered metal-blade assembly, lowering of the porosity level thereof, giving additional strength to the assembly. It is to be noted that the hot isostatic pressing step requires that the exterior surface of the assembly be sealed to minimize the possibility of surface connected internal porosity which may lead to inefficient consolidation. If the sintering cycles does not give a complete seal to the exterior surface of the part by metallurgical bonding, supplementary sealing processes may be used. These supplementary processes include electroplating of metal, vapor deposition of a thin film of metal, sputtering, or electron beam vaporization.

While the preferred embodiment of the invention has been disclosed, it should be appreciated that the invention is susceptible of modification without departing from the scope of the following claims.

We claim:

1. A method of manufacturing a turbine wheel or the like comprising the steps of;
   (a) mounting a plurality of preformed blades in a pair of radially spaced, concentric rings,
   (b) filling the space between said rings and around said blades with an elastomeric material to form an elastomeric mold insert, having radially extending blades mounted therein,
   (c) mounting said mold insert and blades between elastomeric top and bottom plates,
   (d) sealing the radially outer face of said mold insert with an elastomeric material,
   (e) filling the space radially inwardly of said mold insert with powdered metal through an aperture in one of said plates,
   (f) sealing the aperture in said one plate with an elastomeric material to define a sealed elastomeric mold,
   (g) cold isostatic pressing the powder within said mold,
   (h) stripping said elastomeric mold and elastomeric mold insert from said pressed powdered metal and blades, and
   (i) heating said powdered metal and blades to effect metallurgical bonding thereof.

2. The method of claim 1 including the additional step of hot isostatic pressing the powder metal-blade assembly.

* * * * *